United States Patent [19]

Martinez

[11] 3,977,948

[45] Aug. 31, 1976

[54] PROCESS FOR COLORING, BY ELECTROLYSIS, AN ANODIZED ALUMINUM OR ALUMINUM ALLOY PIECE

[75] Inventor: Dionisio Rodriguez Martinez, Pamplona, Spain

[73] Assignee: Iongraf, S.A., Spain

[22] Filed: Aug. 28, 1975

[21] Appl. No.: 608,774

Related U.S. Application Data

[63] Continuation of Ser. No. 444,547, Feb. 20, 1974, abandoned.

[52] U.S. Cl. ..... 204/35 N

[51] Int. Cl.[2] ..... C25D 11/22

[58] Field of Search ..... 204/35 N

[56] References Cited

UNITED STATES PATENTS

| | | | |
|---|---|---|---|
| 3,669,856 | 6/1972 | Gedde | 204/35 N |
| 3,787,295 | 1/1974 | Endinger et al. | 204/35 N |
| 3,892,636 | 7/1975 | Kaneda et al. | 204/35 N |
| 3,929,593 | 12/1975 | Sugiyama et al. | 204/35 N |

*Primary Examiner*—R. L. Andrews

*Attorney, Agent, or Firm*—Wenderoth, Lind & Ponack

[57] ABSTRACT

A process for coloring an aluminum or aluminum alloy piece previously subjected to anodic oxidation, in which codeposition of at least one metal selected from the group consisting of nickel, cobalt, and cadmium with at least one auxiliary metal is carried out by stirring, and applying an alternating voltage between such piece and a counterelectrode immersed in a bath containing the salts of the mentioned metals. The alternating voltage, for each period, has a zero value for at least a certain period of time, and the bath has a pH below or equal to 1.8 and contains at least one auxiliary metal salt selected from the group consisting of copper and tin salts. The concentration of the auxiliary metal salt in the bath is lower than 2.5 g/l and the concentration in the bath of the salt selected from the Ni, Co and Cd salt is preferably lower than 200 g/l.

13 Claims, 3 Drawing Figures

PROCESS FOR COLORING, BY ELECTROLYSIS, AN ANODIZED ALUMINIUM OR ALUMINUM ALLOY PIECE

This is a continuation of application Ser. No. 444,547, filed Feb. 20, 1974, now abandoned.

BACKGROUND OF THE INVENTION

This invention refers to a novel process for coloring aluminum or aluminum alloy pieces or objects whose surfaces have previously been subjected to anodic oxidation.

The term "aluminum" will hereinafter refer to the metal and its alloys, and "anodized aluminum" will refer to any aluminum or aluminum alloy piece or object whose surface has been subjected to an anodic oxidation.

Various processes for coloring aluminum are known, amongst which are those pertaining to the so-called "two-phase" technique, i.e., the formation of an aluminum oxide layer and then electrodeposition of colored metallic compounds.

Norwegian Pat. No. 69,930, which refers to the known two-phase technique, particularly contemplates the use of an acid electroplating bath through which an alternating current is passed and which contains, on the one hand, one or more salts of a group consisting of Fe, Co, Ni, Mn and/or Cr salts and, on the other hand, an amount less than 10 g/l of one or more soluble compounds of another group of salts consisting of As, Sb, Bi, Se, Te and/or Sn soluble compounds. With a bath of this type, various bronzed tones have been obtained on the surface of the aluminum articles when colored substances of metals such as Fe, Co, Ni or Mn were deposited on the pores of the oxide layer. To carry out the codeposition of the metals of the two groups, it has been necessary to maintain the As, Sb, Bi, Se and/or Sn content below a certain limit, in order to maintain a current density which can be used industrially.

This process presents various drawbacks. The current density, when the bath primarily contains nickel, should be as low as possible in order to avoid perforated discharges or a concentric spalling of the oxide layer. The duration of the treatment should be increased, to obtain adequate coloring, thus decreasing economical use of the process, on the one hand, and increasing the risk of disruptive discharges, on the other.

Along these same lines, it is known that British Pat. No. 1,022,927 claims a process for coloring aluminum wherein an alternating current is passed between an aluminum piece and a counterelectrode, particularly made of retort carbon or gas carbon, carborundum or aluminum. The bath contains a small amount of an Ni, Co, Cr, Cd, V, Au, Ag, Fe or Pb salt.

Since this latter process presented the same drawbacks as those indicated above, consideration was given to French Pat. No. 2,011,176 which claims the application of an asymmetric alternating voltage between an anodized aluminum article and a counterelectrode immersed in a bath containing salts capable of coloring the aluminum oxide layer.

On the other hand, to overcome the drawbacks of the prior art and to deposit tin on anodized aluminum, in order to obtain coloration, French Pat. No. 2,047,917 contemplates a process according to which an acid bath containing tin salts and a tin complex agent is used with the purpose of avoiding the oxidation of tin (II) to tin (IV). An alternating current, which is applied between the aluminum piece to be treated and and a tin or titanium counterelectrode, is passed through the bath. The pH of the bath is preferably in the range of from 0.8 to 1.5 and the current density can vary from 0.2 to 1.0 A/dm$^2$, or it can even be above 1.0 A/dm$^2$.

It is evident that only specific coloring of the tin can be obtained by applying this process, i.e., bronzed colors with greenish tints, which can reach black.

However, at present, the colorings required by the construction and architectural industries have warmer tones which cannot be obtained with the tin salt baths contemplated in French Pat. No. 2,047,917.

SUMMARY OF THE INVENTION

The object of the present invention is to obtain, on the surface of an anodized aluminum piece or object, a bronze tone by means of the deposition of one or more metals, such as Ni, Co and Cd, so that:

a. the process does not present the drawbacks of the prior art;
b. the shade obtained is uniform and sufficiently dark; and
c. the carrying out of such process is industrially profitable.

To this effect, a solution which differs completely from those contemplated in French Pat. Nos. 2,011,376 and 2,047,917 has been reached to overcome the insufficiency of distributing the current in known baths, which insufficiency is mainly due to the reduced conductivity of the baths.

To increase the heat conductivity of the bath, it is necessary to operate at a very low pH. However, such pH does not permit deposition of the metals of the group consisting of nickel, cobalt and cadmium. This group will hereinafter be referred to as the "fundamental group."

It has surprisingly been found, in order to obtain the Ni, Co and/or Cd plating tones, that one or more metals of the fundamental group could be deposited at a pH below or equal to 1.8 in the presence of one or more auxiliary metal salts "nobler" than the metals of the fundamental group, provided that a special alternating voltage is applied.

The main idea was the following: since, when operating at a pH below or equal to 1.8, it is impossible to deposit one or more metals of the fundamental group alone on the anodized aluminum, a codeposition of one or more metals of the fundamental group with one or more nobler auxiliary metals should be effected and a portion of the auxiliary metal or metals deposited on the aluminum oxide layer should be re-dissolved.

The main difficulty of the basic principal, according to which penetration of the ion or ions to be deposited is facilitated by the use of one or more auxiliary cations, resides in that the auxiliary cation is deposited with more ease than the fundamental cation and is thus preferred. Therefore, use is made of the favorable action of the auxiliary cation to its utmost. Consequently, it is necessary to use that which tends to reduce the effect of the presence of the auxiliary cation in the final deposition.

In practice, to overcome the difficulties posed by the use of an auxiliary metal salt under the relatively unfavorable deposition conditions of the auxiliary metal, it has been necessary to determine the precise operative modalities which permit the exact reproduction of the desired shades, so that:

a. The influence of the color corresponding to the auxiliary is as weak and trustworthy as possible, in the color obtained; and b. A dissolving effect of the bath, in view of the auxiliary which is deposited, is produced during deposition.

The present invention contemplates a process for coloring an aluminum or aluminum alloy piece which has previously been subjected to anodic oxidation, wherein codeposition of at least one metal selected from the group consisting of nickel, cobalt and cadmium with at least one auxiliary metal is carried out by stirring, and applying an alternating voltage between the piece and a counterelectrode immersed in a bath containing the salts of the metals. The alternating voltage, for each period, has a zero value, at least for a certain finite period of time. The pH of the bath is below or equal to 1.8, and the bath contains at least one auxiliary metal salt selected from the group consisting of copper or tin salts. The concentration of the auxiliary metal salt in the bath is below 2.5 g/l, and the concentration in the bath of the salt selected from Ni, Co and Cd is preferably below 200 g/l.

The concentration of the auxiliary metal salt is always lower than 2.5 g/l, so that its influence on the coloring to be obtained is minimum.

The practical coloring effect obtained for auxiliary metal salt concentrations in the range of 10 g/l is that which results when the auxiliary metal, primarily tin, is used.

It has been observed that with this concentration, when a pure alternating current and only the auxiliary cation are used and when the action of the current ceases, the dissolving action of the bath on the deposition obtained is very important and the color obtained can disappear completely. This action is more reduced when the concentration of the auxiliary metal used by itself is higher. Therefore, this action is practically negligible when concentrations in the range of 10 g/l are used.

Therefore, under the working conditions chosen in the process of the present invention, the auxiliary metal salt concentrations used are as reduced as possible, in order to diminish as much as possible the relation between the elements which are jointly deposited.

From the aforegoing, it can be deduced that under these working conditions and to enhance the dissolving action of the bath on the auxiliary cation, it is necessary, once the mentioned process has commenced and therefore when deposition has started, to respect the periods of time during which current does not flow.

Consequently, a pure alternating current is not suitable for this process.

Preferable is a symmetric alternating voltage which has an instantaneous zero value for a total duration corresponding to half of each period.

Suitable pH conditions are obtained by adding acids which can act on the auxiliary cation, tending to eliminate it after its deposition. Naturally, the eliminating or dissolving action of the acid on the auxiliary cation can be promoted by varying the temperature. Likewise, organic acids which favor the stability of the auxiliary cation, when this is necessary, can be added to the bath.

Should the auxiliary cation be tin, the mentioned stability can be obtained by conventional means, well known in the process of tinplating deposition, that is by adding organic acids selected from the group of phenols, sulfones, etc., mainly sulfophthalic, phenolsulfonic and cresolfonic acids.

According to a preferred embodiment, necessary measures are taken so that the temperature of the bath will range from about 15° to about 25°C., i.e., a value close to ambient temperature.

The alternating voltages used are those which have time intervals during which current does not flow. The attached figures represent some examples of usable voltages, which are in no way limiting.

DETAILED DESCRIPTION OF THE INVENTION

Figure 1:
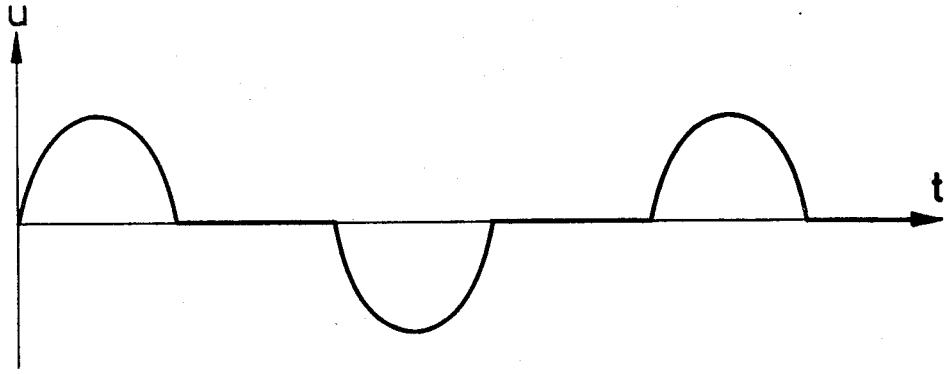
FIG. 1 graphically illustrates an alternating wave voltage, with respect to a period N, which is sinusoidal and positive for 0.5 N, zero for N, and sinusoidal and negative for 0.5 N.
Figure 2:
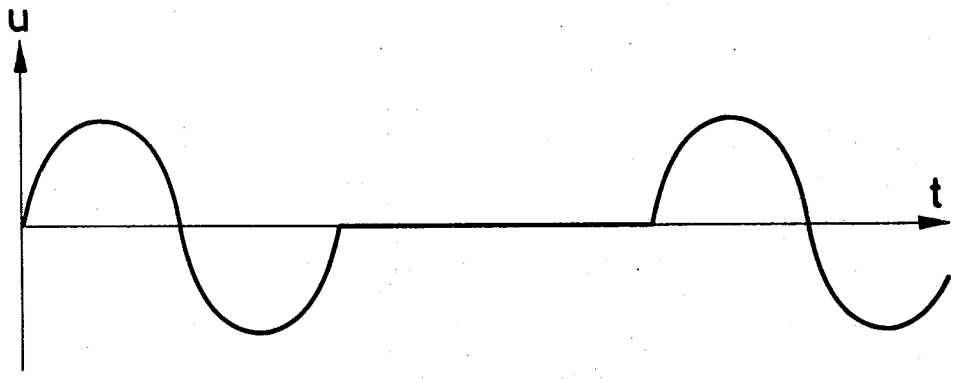
FIG. 2 graphically illustrates an alternating wave voltage with respect to a period N, which is sinusoidal and non-zero for a period N, and then zero for a period N.

The voltages of FIGS. 1 and 2 are obtained according to the new technique of controlled diodes, for example mainly by means of thyristors and triads.

Figure 3:
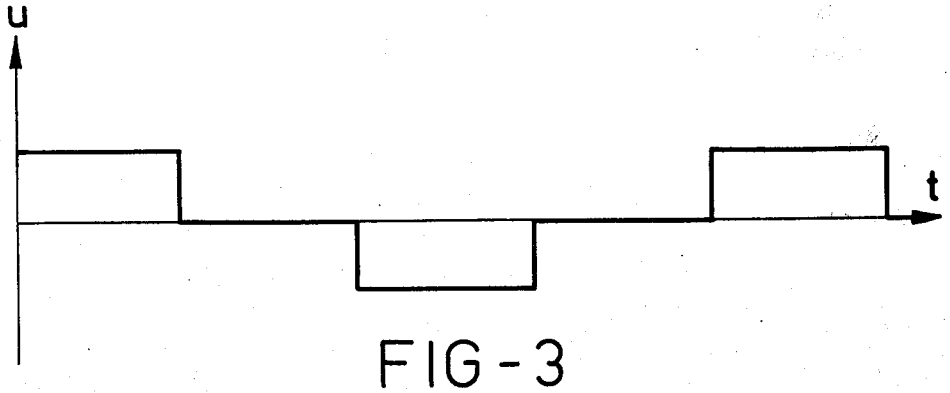
FIG. 3 graphically illustrates an alternating wave voltage with respect to a period N, which is continuous and positive for 0.5 N, zero for 0.5 N, continuous and negative for 0.5 N, and zero for 0.5 N.

The type of wave represented in FIG. 3 is obtained by starting with a tri-phase alternating current, contrary to the tendency heretofore followed in coloring techniques, which start with monophasic alternating currents.

The use of this type of wave makes it possible to obtain a more effective action of the current, since it starts with a constant current value for each polarity.

Besides, in practice, the use of triphasic transformers avoids, when their voltage is high, unbalances between phases produced when tri-monophasic transformers are used.

Copper and/or tin are used as auxiliary metal salts, Under the operative conditions previously established, none of these cations, when used independently, provide a satisfactory effect.

Thus, if the auxiliary cation (for example the tin cation) is left alone, a color is produced, but the chemical action of the bath tends to eliminate it. If the nickel cation is left alone, no color is produced.

The need to operate with low pH values is determined by obtaining the highest possible conductivity of the electrolyte, so that the predominant resistance, in the coloring process, is that of the aluminum oxide film. Consequently, the process is so developed that deposition is automatically controlled by the resistance of the aluminum oxide film, and the deposition is achieved with perfect uniformity even in zones the access to which is difficult, thus eliminating the shade effect which is a difficult feature in all galvanizing processes.

According to the process of the present invention, a darker and more uniform coloration is obtained, even on pieces, the anodic films of which have discontinuities in their electric resistance, as in the case of casting pieces, aluminum alloys containing copper, and aluminum alloys having a high silicon content.

The importance of operating under pH conditions below 1.8 should be emphasized because if this were not so, i.e., if a pH above 1.8 is used (in the processes presently used the pH varies mainly from 4.5 to 6.5), the silicon content of the alloys utilized in architecture would have such an influence on the coloration that when the silicon content is high, within permissible limits, various difficulties are posed in order to obtain dark shades, since the aluminum alloys destined for architecture have, according to diverse international norms, a silicon content of approximately 0.2 to 0.6% by weight, with respect to the weight of the alloy.

Furthermore, better results are obtained with the process of the present invention than with classic methods of coloration by immersion, even with pieces having residues of acids coming from anodic oxidation baths, as in the case of wedged or nailed pieces or faulty weldings.

It is advisable to stir the bath during the process of the present invention.

Generally, inert counterelectrodes, mainly graphite electrodes, are employed.

The duration of the treatment, which has an influence on the final result of the colorations and on the properties of the colorations, is more than or equal to 3 minutes, and is preferably from about 3 to about 30 minutes.

A preferred embodiment is that which consists in depositing on the surface of a previously anodized aluminum piece a fundamental metal with a nobler auxiliary metal, applying to a bath containing the salts of these metals, at a pH below or equal to 1.5 and at a temperature of about 15 to 25°C., a symmetric alternating voltage which, during a given period, has a zero value for a total finite period of time corresponding to half such period, so that:

1. Operation is carried out under a voltage of 15 V for 2 minutes and then;

2. Operation is carried out under a voltage of 18 V for 5 to 25 minutes.

Finally, the process of the present invention permits the simultaneous treatment of pieces having different shapes and sizes, precisely due to the ease with which penetration is obtained.

This is applied to soldered frames, to profiles having different shapes and lengths, open, closed, etc.

Other advantages and characteristics of the invention will become evident from the following working examples, which are in no way limiting and which are only given by way of example.

EXAMPLE 1

Coloration of an aluminum plate previously subjected to anodic oxidation is carried out by applying to the terminals of a bath an alternating voltage, according to FIG. 1, wherein each semi-period of a pure alternating current is followed by a semi-period of rest. The electroplating bath has the following composition and criteria:

| | |
|---|---|
| $NiSo_4$ | 150 g/l |
| $SnSo_4$ | 2 g/l |
| o-Phenolsulfonic acid | 1 g/l |
| $H_2SO_4$ in a sufficient amount for a pH of | 1.5 |
| Ambient temperature | 15–25°C. |

A voltage of 15 V, according to the pattern of FIG. 1, is applied for 2 minutes followed by a voltage of 18 V, always according to the pattern of FIG. 1, for 5 minutes. A uniform bluish-bronze tone differing from the greenish-bronze of the tin only, is obtained.

EXAMPLE 2

Coloration of an aluminum plate previously subjected to anodic oxidation is carried out by applying to the terminals of a bath a voltage, according to FIG. 2, which is a pure alternating wave voltage, wherein each voltage period is followed by a break having a duration corresponding to the period of the wave voltage. The bath has the following composition and criteria:

| | |
|---|---|
| $CoSo_4$ | 160 g/l |
| $SnSo_4$ | 2 g/l |
| 4-(o-cresol)sulfonic acid | 2 g/l |
| $H_2SO_4$ in a sufficient amount for a pH of | 1.4 |
| Ambient temperature | 15–25°C. |

Following the procedure of Example 1, a voltage of 15 V is applied for 2 minutes followed by a voltage of 18 V for 5 minutes.

A uniform bronze tone differing from the greenish tone of tin only, is obtained.

EXAMPLE 3

Coloration of an aluminum plate is carried out using a bath identical to that represented in Example 1. The alternating voltage used is that of FIG. 3, i.e., uniform and positive for 0.5 N, zero for 0.5, uniform and negative for 0.5, and zero for 0.5 N.

A voltage of 15 V is applied for 2 minutes, and is converted within 2 minutes to a voltage of 18 V, which is maintained for 20 to 25 minutes. A blackish-bronze tone is obtained.

I claim:

1. A process for coloring an aluminum or aluminum alloy piece previously subjected to anodic oxidation, said process comprising:

placing said piece in a bath containing the salt of at least one fundamental metal selected from the group consisting of nickel, cobalt and cadmium and the salt of at least one auxiliary metal selected from the group consisting of copper and tin;

maintaining the pH of said bath no greater than 1.8;

maintaining the concentration of the auxiliary metal salts in said bath lower than 2.5 g/l;

maintaining the concentration of the fundamental metal salts in said bath lower than 200 g/l;

stirring said bath; and applying between said piece and a counterelectrode immersed in said bath an alternating voltage which, with respect to a period N, is sinusoidal and positive for 0.5 N, zero for 0.5 N, sinusoidal and negative for 0.5 N, and zero for 0.5 N.

2. A process as claimed in claim 1, wherein the length of time of said process is at least 3 minutes.

3. A process as claimed in claim 2, wherein said alternating voltage is a voltage of 15 V applied for two minutes, followed by a voltage of 18 V applied for from 5 to 25 minutes.

4. A process as claimed in claim 1, further comprising maintaining the temperature of said bath at approximately from between 15° to 25°C.

5. A process for coloring an aluminum or aluminum alloy piece previously subjected to anodic oxidation, said process comprising:

placing said piece in a bath containing the salt of at least one fundamental metal selected from the group consisting of nickel, cobalt and cadmium and the salt of at least one auxiliary metal selected from the group consisting of copper and tin;

maintaining the pH of said bath no greater than 1.8;

maintaining the concentration of the auxiliary metal salts in said bath lower than 2.5 g/l;

maintaining the concentration of the fundamental metal salts in said bath lower than 200 g/l;

stirring said bath; and applying between said piece and a counterelectrode immersed in said bath an alternating voltage which, with respect to a period N, is sinusoidal and alternating for a period N and zero for a period N.

6. A process as claimed in claim 5, wherein the length of time of said process is at least 3 minutes.

7. A process as claimed in claim 6, wherein said alternating voltage is a voltage of 15 V applied for 2 minutes, followed by a voltage of 18 V applied for from 5 to 25 minutes.

8. A process as claimed in claim 5, further comprising maintaining the temperature of said bath at approximately from between 15° to 25°C.

9. A process for coloring an aluminum or aluminum alloy piece previously subjected to anodic oxidation, said process comprising:

placing said piece in a bath containing the salt of at least one fundamental metal selected from the group consisting of nickel, cobalt and cadmium and the salt of at least one auxiliary metal selected from the group consisting of copper and tin;

maintaining the ph of said bath no greater than 1.8;

maintaining the concentration of the auxiliary metal salts in said bath lower than 2.5 g/l;

maintaining the concentration of the fundamental metal salts in said bath lower than 200 g/l;

stirring said bath; and applying between said piece and a counterelectrode immersed in said bath an alternating voltage which, with respect to a period N, is a continuous and positive square wave for 0.5 N, zero for 0.5 N, a continuous and negative square wave for 0.5 N, and zero for 0.5 N.

10. A process as claimed in claim 9, wherein the length of time of said process is at least 3 minutes.

11. A process as claimed in claim 10, wherein said alternating voltage is a voltage of 15 V applied for 2 minutes, followed by a voltage of 18 V applied for 5 to 25 minutes.

12. A process as claimed in claim 11, wherein said alternating voltage is converted from 15 V to 18 V in two minutes.

13. A process as claimed in claim 9, further comprising maintaining the temperature of said bath at approximately from between 15° to 25°C.

* * * * *